US005807147A

United States Patent [19]

Bickford

[11] Patent Number: 5,807,147

[45] Date of Patent: Sep. 15, 1998

[54] CENTER CONTACT FOR RF CABLE

[75] Inventor: Wayne Francis Bickford, Epping, N.H.

[73] Assignee: The Whitaker Corporation, Wilmington, Del.

[21] Appl. No.: 785,405

[22] Filed: Jan. 22, 1997

[51] Int. Cl.[6] ..... H01R 11/22

[52] U.S. Cl. ..... 439/851; 439/578

[58] Field of Search ..... 439/675, 842, 439/851, 852, 843, 856, 578, 579, 580, 581, 582, 583, 584, 585

[56] References Cited

U.S. PATENT DOCUMENTS 4,932,897 6/1990 Lee et al. ..... 439/851

5,021,010 6/1991 Wright ..... 439/578

*Primary Examiner*—Gary F. Paumen
*Assistant Examiner*—Yong Ki Kim
*Attorney, Agent, or Firm*—Gerald K. Kita

[57] ABSTRACT

An electrical contact for terminating a cable conductor is constructed with; a conductor terminating portion (27) in the form of a metal strip (28) in the shape of a cylinder (33) and multiple cantilever spring fingers (32) projecting inward from the cylinder (33) for gripping a conductor of an electrical cable, and tips (38) on the spring fingers (32) being bent with a corresponding twist to form respective converging sides of a funnel shaped receptacle (39) to terminate varying sizes of an electrical conductor of a cable.

10 Claims, 2 Drawing Sheets

CENTER CONTACT FOR RF CABLE

FIELD OF THE INVENTION

The present invention relates to an electrical contact for rf cable, and, more particularly, to a center contact that adapts to different conductor sizes of different rf cables.

BACKGROUND OF THE INVENTION

A known electrical contact is described in U.S. Pat. No. 4,728,304, and comprises, converging spring fingers that extend from a hollow cylinder to form respective sides of an electrical receptacle. The electrical receptacle is adapted to grip a mating electrical contact. These types of spring fingers are excessively stressed when spread apart too far, and limit the size of the mating electrical contact that can be mated to the receptacle. A similar limitation is experienced when an electrical contact is used as a center contact that is required to terminate a center conductor of an rf cable. Such rf cables are known to vary with different diameters of center conductors. An electrical contact is needed that will adapt to terminate center conductors of different diameters.

Additionally, an electrical contact is needed in combination with a mating contact portion and a conductor terminating portion that adapts for connection to different diameters of cable conductors.

SUMMARY OF THE INVENTION

According to the invention, an electrical contact for terminating cable conductors advantageously adapts to different diameters of conductors. The electrical contact advantageously comprises, a unitary metal strip formed into a cylinder, free ends of spring fingers converging toward one another to grip an electrical conductor of a cable, and the spring fingers extending helically along the cylinder where they join the cylinder. A feature of the invention resides in cantilever spring fingers that converge to define an electrical receptacle, and that extend helically to lengthen their spring lengths. The lengthened spring lengths allow the spring fingers to deflect over a wide range to adapt for connection to different diameters of cable conductors.

According to another aspect of the invention, an electrical contact adapted for terminating cable conductors of different diameters, further is adapted for combination with a mating contact portion and a conductor terminating portion that adapts for connection to different diameters of cable conductors. The electrical contact advantageously comprises, cantilever spring fingers projecting inwardly from a cylinder, and a metal sleeve, the conductor terminating portion being mounted in a rear end of the sleeve, and a mating contact portion secured in a front end of the sleeve.

An embodiment of the invention will now be described by way of example with reference to the accompanying drawings, according to which:

DETAILED DESCRIPTION

Figure 5:
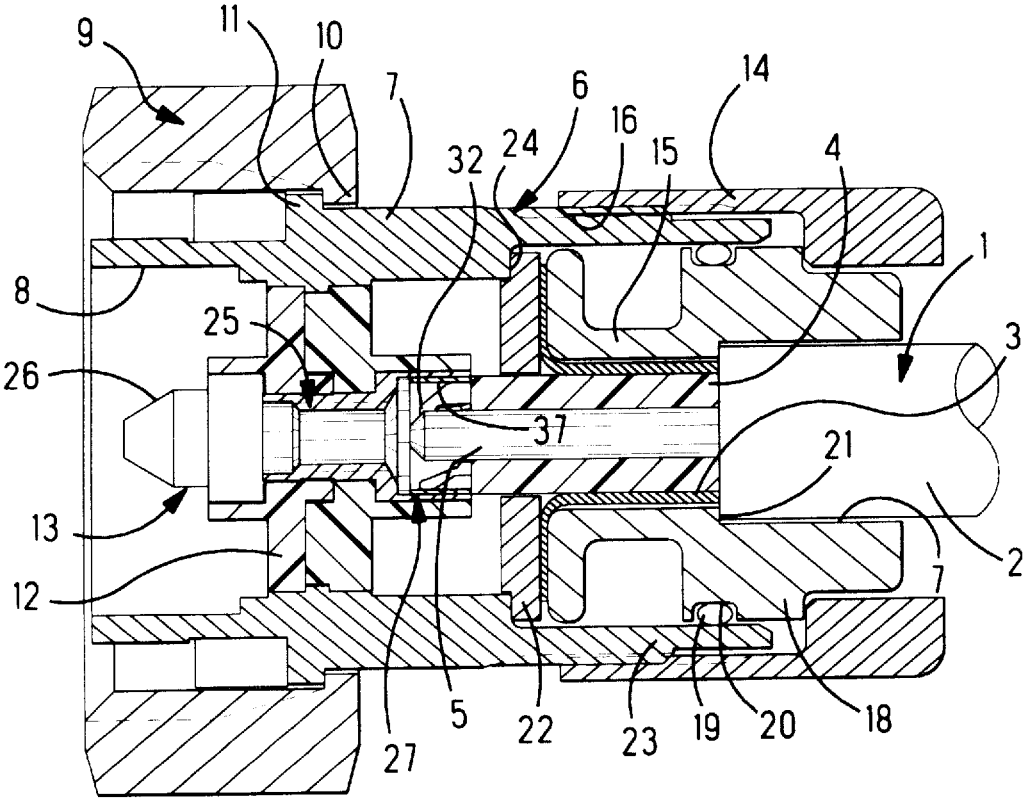
FIG. 5 is a section view of an electrical connector terminating an electrical cable.

With reference to FIG. 5, a coaxial electrical cable 1 will now be described. The cable 1 is of known construction, and comprises, an exterior jacket 2 of dielectric material that concentrically surrounds a conducting metal braid 3. The braid 3 concentrically surrounds a dielectric 4. The dielectric 4 concentrically surrounds a center conductor 5 of the cable 1. The braid 3 provides an electrical shield, and is referred to as an outer conductor of the cable 1. The concentric parts of the cable 1 are trimmed back from an end of the cable 1 to protrude an exposed center conductor 5 from the dielectric 4, and to protrude an exposed dielectric 4 and an exposed braid 3 from the jacket. The cable 1 is ready for termination to an electrical connector 6.

With reference to FIG. 5, the electrical connector 6 for termination of the cable 1 will now be described. The connector 6 comprises, an exterior, conducting shell 7. The shell 7 has an open mating end 8 encircled by a rotatable coupling nut 9. The coupling nut 9 is retained on the shell 7 by overlapping flanges 10, 11, one of the flanges 10 being on an interior of the nut 9, and another of the flanges 11 being on an exterior of the shell 7. The nut 9 is internally threaded to provide a threaded coupling. The shell 7 concentrically surrounds a dielectric body 12. The dielectric body 12 concentrically encircles a conducting center contact 13 for terminating the center conductor 5 of the cable 1.

The center contact 13 faces the mating end 8 of the shell 7.

With further reference to FIG. 5, assembly of the cable 1 with various parts of the connector 6 will now be described. The cable 1 is assembled through a coupling cylinder 14, followed by a conducting shim 15. The coupling cylinder 14 is internally threaded within a front facing open end 16. The shim 15 comprises, an open rear end 17 that surrounds the jacket of the cable 1, and extends through the coupling cylinder 14. A rear facing step 18 on the shim 15 is impinged by the coupling cylinder 14. A sealing ring 19 registers in an exterior groove 20 in the step 18. An interior shoulder 21 on the shim 15 faces to the rear, and stops against a trimmed back end of the jacket 2. The shim 15 surrounds the exposed braid 3 of the cable 1. The exposed braid 3 is lifted and turned back to overlap a front of the shim 15. A conducting clamp cylinder 22 is assembled over the exposed dielectric 4 of the cable 1. The clamp cylinder 22 faces the turned back portion of the braid 3. The braid 3 is clamped between the clamp cylinder 22 and the front of the shim 15.

With further reference to FIG. 5, assembly of the cable 1 with the shell 7 of the connector 6 will now be described. The cable 1 is inserted into an open rear end 23 of the shell 7, which urges the center conductor 5 of the cable 1 into electrical mating connection with the center contact 13 of the connector 6. The coupling cylinder 14 is threadably advanced along an externally threaded portion on the rear end 23 of the shell 7. The clamp cylinder 22 and the shim 15 become compressed between the coupling cylinder 14 and a rear facing shoulder 24 on an interior of the shell 7, which clamps the braid 3 of the cable 1 to establish an electrical connection, which terminates the braid 3 with the outer shell 7 of the connector 1.

Figure 7:
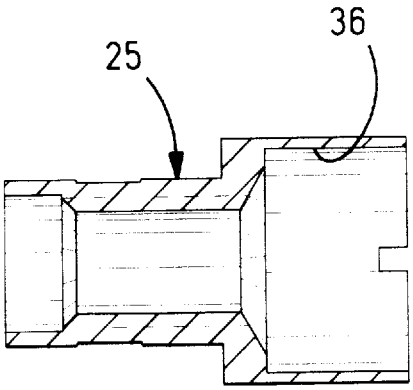
FIG. 7 is a section view taken along the line 7—7 of FIG. 6.
Figure 6:
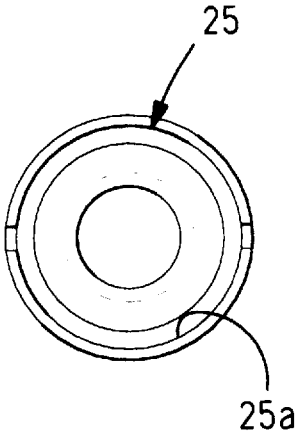
FIG. 6 is an end view of a center contact in the form of a conducting sleeve.

With reference to FIGS. 5, 6 and 7, the electrical contact 13 will now be described. The electrical contact 13 comprises, a conducting sleeve 25, a mating contact portion 26 secured in an open front end of the sleeve 25 and a conductor terminating portion 27 in an open rear end 25*a* of the sleeve 25 for terminating the center conductor 5 of the electrical cable 1. For example, the mating contact portion 26 is a prong of an electrical plug. The plug is interchangeable with another mating contact portion 26 of a different shape or having different dimensions.

Figure 3:
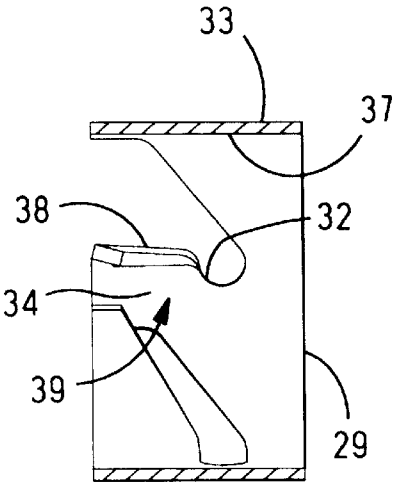
FIG. 3 is a section view taken along the line 3—3 of FIG. 1.
Figure 4:
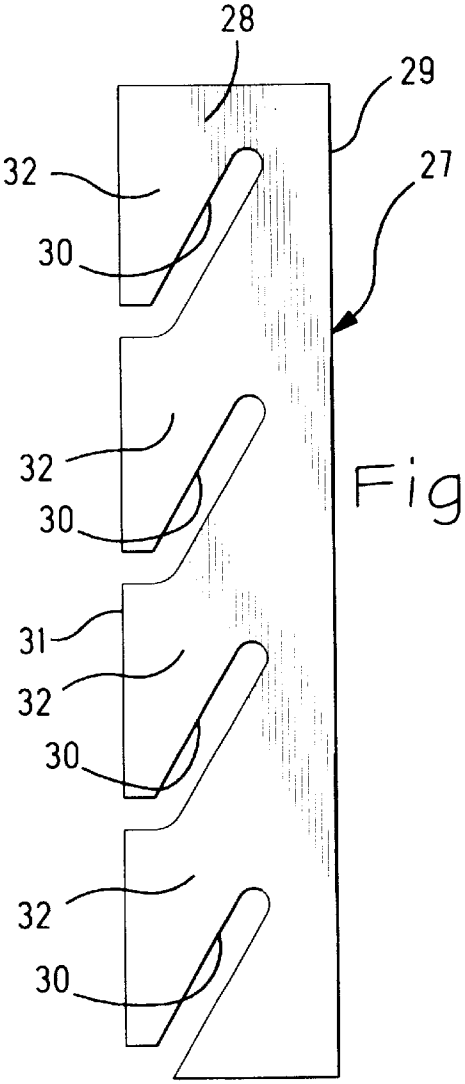
FIG. 4 is a top view of a metal strip.

With reference to FIG. 4, the conductor terminating portion 27 will now be described. The conductor terminating portion 27 is fabricated from a unitary metal strip 28, FIG. 4, having a plane of thickness. One longitudinal edge 29 of the strip 28 is continuous. The metal strip 27 has multiple diagonal slots 30. The slots 30 intersect one longitudinal edge 31 of the strip 28 and extend diagonally along the strip 28 toward the continuous edge 29. The slots 30 are spaced apart to define multiple, cantilever spring fingers 32 extending diagonally of the strip 28. When the strip 28 is formed into a hollow cylinder 33, FIGS. 1, 2 and 3, the spring fingers 32 extend helically where they adjoin the cylinder 33. A thickness plane of the strip 28 forms a thickness plane of the cylinder 33. Further, free ends 34 of the spring fingers 32 are bent to extend out of the thickness plane of the cylinder 33, and converge toward one another inward from the cylinder 33 to grip the conductor 5 of the electrical cable 1, and to establish an electrical connection with said conductor 5.

Figure 1:
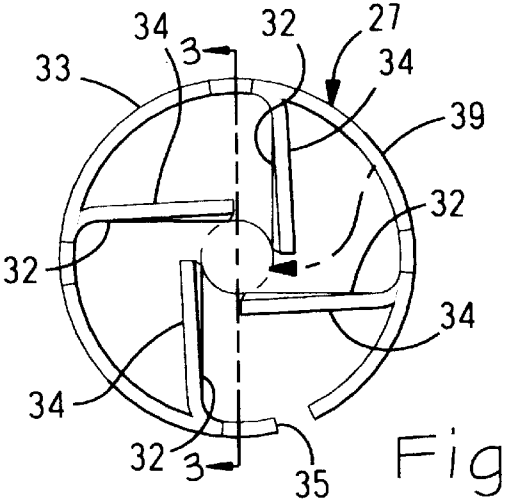
FIG. 1 is an end view of an electrical contact.

With reference to FIG. 1 the cylinder 33 has an open, longitudinal seam 35 that allows the cylinder 33 to expand resiliently. When the cylinder 33 is press fit in the open rear end of the sleeve 25, the cylinder 33 expands resiliently to engage, and conform to, an interior surface 36 in the rear end of the sleeve 25. A first open end 37 of the cylinder 33 faces rearwardly to receive the center conductor 5 of the cable 1. The spring fingers 32 extend from the open end 37 of the cylinder 33, and diagonally forward.

Figure 2:
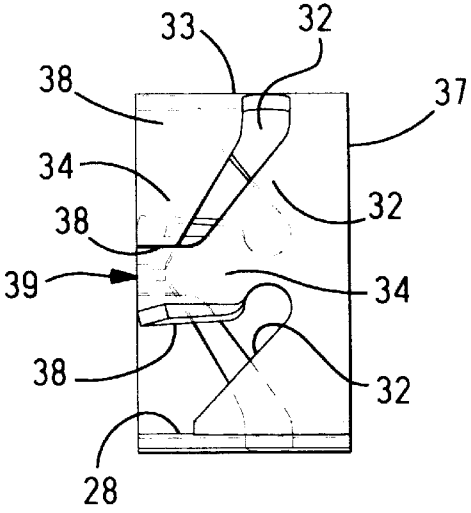
FIG. 2 is a side view of the electrical contact, as shown in FIG. 1.

With reference to FIGS. 1, 2 and 3, tips 38 on the free ends 33 of the spring fingers 32 are bent with a twist to form respective converging side walls of a funnel, the funnel providing an electrical receptacle 39 to receive and establish an electrical connection with the electrical conductor 5 of the cable 1. The central axis of the electrical receptacle 39 is coincident with a central axis of the cylinder 33. The center conductor 5 is funneled along the side walls of the tapered electrical receptacle 39 to become wedged among the tips 38 of the spring fingers 32. The tips 38 of the spring fingers 32 resiliently grip the center conductor 5, to establish an electrical connection that terminates the center conductor 5 with the center contact 13.

An advantage of the invention resides in an electrical contact with a terminating portion that adapts to terminate cable conductors of different diameters.

Another advantage of the invention resides in an electrical contact in combination with a mating contact portion and a conductor terminating portion that adapts for connection to different diameters of cable conductors.

Although a preferred embodiment has been described, other embodiments and modifications of the invention are intended to be covered by the spirit and scope of the appended claims.

What is claimed is:

1. An electrical contact comprising: a conductor terminating portion comprising; a metal strip formed into a cylinder and multiple cantilever spring fingers projecting inward from the cylinder for gripping a conductor of an electrical cable; a conducting sleeve, the conductor terminating portion being mounted in a rear end of the sleeve, and a mating contact portion secured in a front end of the sleeve.

2. An electrical contact as recited in claim 1 wherein, the spring fingers converge along a tapered cavity, the tapered cavity is defined by the spring fingers, and the tapered cavity is located along a central axis of the cylinder to funnel a conductor to be gripped by the spring fingers.

3. An electrical contact as recited in claim 1 wherein, tips of the spring fingers are positioned around a reduced circumference of a clearance space to grip a conductor of an electrical cable.

4. An electrical contact as recited in claim 1 wherein, tips of the spring fingers are positioned around a reduced circumference of a clearance space to grip a conductor of an electrical cable, and the clearance space is located along a central axis of the cylinder.

5. An electrical contact as recited in claim 1 wherein, the cylinder conforms to an interior surface in the rear end of the sleeve.

6. An electrical contact as recited in claim 1 wherein, tips of the spring fingers are bent out of a thickness plane of the cylinder to form an electrical receptacle of reduced circumference within the cylinder.

7. An electrical contact as recited in claim 1 wherein, first ends of the spring fingers join a first open end of the cylinder, and the spring fingers turn along their lengths to extend along a second open end of the cylinder.

8. An electrical contact as recited in claim 7 wherein, tips of the spring fingers are positioned around the second open end to grip a conductor of an electrical cable, and the second open end has a reduced circumference as compared with the circumference of the first open end of the cylinder.

9. An electrical contact comprising: a unitary metal strip having diagonal cantilever spring fingers, the metal strip being formed into a cylinder, free ends of the spring fingers being bent to extend out of a thickness plane of the cylinder and to converge toward one another to grip an electrical conductor of a cable, and tips on the free ends being bent with a twist to form respective converging sides of a funnel, the funnel providing an electrical receptacle to receive and establish an electrical connection with an electrical conductor of a cable.

10. An electrical contact comprising: a unitary metal strip having diagonal cantilever spring fingers, the metal strip being formed into a cylinder, free ends of the spring fingers being bent to extend out of a thickness plane of the cylinder and to converge toward one another to grip an electrical conductor of a cable, the spring fingers extending helically alone the cylinder where they join the cylinder, and tips on the free ends being bent with a twist to form respective converging sides of a funnel, the funnel providing an electrical receptacle to receive and establish an electrical connection with an electrical conductor of a cable.

* * * * *